US009963313B2

(12) United States Patent
Nishihara et al.

(10) Patent No.: US 9,963,313 B2
(45) Date of Patent: May 8, 2018

(54) SHEET FEEDING APPARATUS HAVING CONTAINING AREA FOR FEEDING SHEET AND CONTAINING AREA FOR REPLENISHING SHEET, AND IMAGE FORMING APPARATUS

(71) Applicant: CANON KABUSHIKI KAISHA, Tokyo (JP)

(72) Inventors: Hiroto Nishihara, Tsukuba (JP); Shinnosuke Iwadate, Toride (JP); Teruhito Kai, Kashiwa (JP); Hiromi Shimura, Toride (JP); Keita Takahashi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/254,387

(22) Filed: Sep. 1, 2016

(65) Prior Publication Data

US 2017/0066611 A1 Mar. 9, 2017

(30) Foreign Application Priority Data

Sep. 8, 2015 (JP) ..... 2015-176940

(51) Int. Cl.
*B65H 1/04* (2006.01)
*B65H 7/04* (2006.01)
(Continued)

(52) U.S. Cl.
CPC ..... *B65H 7/04* (2013.01); *B65H 1/04* (2013.01); *B65H 1/28* (2013.01); *B65H 1/30* (2013.01); *G03G 15/5016* (2013.01); *G03G 15/6508* (2013.01); *B65H 2404/733* (2013.01); *B65H 2405/3311* (2013.01); *B65H 2405/351* (2013.01); *B65H 2405/361* (2013.01); *B65H 2551/21* (2013.01); *G03G 15/6514* (2013.01)

(58) Field of Classification Search
CPC ..... B65H 1/28; B65H 1/30; B65H 2404/733; B65H 2405/331; B65H 2405/3311; B65H 2405/351
See application file for complete search history.

(56) References Cited

U.S. PATENT DOCUMENTS 5,096,181 A * 3/1992 Menon ..... B65H 1/266 271/147
5,102,112 A * 4/1992 Takahashi ..... B65H 1/30 271/127

(Continued)

*Primary Examiner* — Jeremy R Severson
(74) *Attorney, Agent, or Firm* — Rossi, Kimms & McDowell LLP

(57) ABSTRACT

A sheet feeding apparatus which is able to make it known that a first containing area for feeding cannot be replenished with sheets in a second containing area for replenishing. A sheet feeding cassette has the first containing area in which sheets to be fed are contained, the second containing area that is adjacent to the first containing area and in which sheets for replenishing are contained, and a sheet mover that transfers the sheets contained in the second containing area to the first containing area. A first detector detects whether or not the sheet mover is at a standby position. When the first detector detects that the sheet mover is not at the standby position, a warning is issued to prompt return of the sheet mover to the standby position.

14 Claims, 13 Drawing Sheets

(51) Int. Cl.

| | |
|---|---|
| ***B65H 1/28*** | (2006.01) |
| ***B65H 1/30*** | (2006.01) |
| ***G03G 15/00*** | (2006.01) |

(56) References Cited

U.S. PATENT DOCUMENTS

| | | | | | |
|---|---|---|---|---|---|
| 5,195,734 | A * | 3/1993 | Tanabe | B65H 3/44 | 271/164 |
| 5,335,903 | A * | 8/1994 | Martin | B65H 1/266 | 271/157 |
| 6,332,609 | B1 * | 12/2001 | Arakawa | B65H 1/04 | 271/157 |
| 7,866,654 | B2 * | 1/2011 | Ohno | B65H 1/28 | 271/157 |
| 8,585,037 | B1 * | 11/2013 | Jacobs | B65H 1/28 | 271/157 |
| 2016/0257507 | A1 * | 9/2016 | Nakagawa | B65H 1/08 | |
| 2017/0066612 | A1 * | 3/2017 | Kinoshita | B65H 7/06 | |

* cited by examiner

SHEET FEEDING APPARATUS HAVING CONTAINING AREA FOR FEEDING SHEET AND CONTAINING AREA FOR REPLENISHING SHEET, AND IMAGE FORMING APPARATUS

BACKGROUND OF THE INVENTION

Field of the Invention

The present invention relates to a sheet feeding apparatus having a containing area for feeding sheet and a containing area for replenishing sheet, and an image forming apparatus.

Description of the Related Art

Conventionally, as a sheet feeding apparatus for an image forming apparatus such as a copier or a printer, what is called a tandem sheet feeding apparatus has been proposed so as to enhance convenience during high-volume continuous printing. In this tandem sheet feeding apparatus, a containing area for feeding in which sheets to be fed for image formation are contained, and in addition, a containing area for replenishing is provided adjacent to the containing area for feeding, and when sheets in the containing area for feeding run out, sheets in the containing area for replenishing are transferred to the containing area for feeding. This increases the number of sheets that can be continuously fed and decreases the frequency with which a user replenishes sheet. According to U.S. Pat. No. 6,332,609 a transfer guide is moved to collectively transfer a sheet bundle contained in the containing area for replenishing to the containing area for feeding.

In such a tandem sheet feeding apparatus, high-volume continuous feeding which is an original purpose is accomplished only by properly stacking sheets in the containing area for feeding and the containing area for replenishing. It is thus necessary to take a prevention measure against abnormal stacking of sheets. According to an arrangement proposed in U.S. Pat. No. 6,332,609, an intermediate sensor is placed midway between the containing area for feeding and the containing area for replenishing, and based on a result of detection by the intermediate sensor at a time point when transfer of sheets to the containing area for feeding is completed, abnormal stacking of sheets in the sheet feeding apparatus is detected.

In the sheet feeding apparatus described in U.S. Pat. No. 6,332,609, however, a user may position the transfer guide between the containing area for feeding and the containing area for replenishing by mistake (for example, by manual operation). When sheets in the containing area for feeding run out during sheet-feeding control in that situation, a sheet bundle in the containing area for replenishing cannot be transferred to the containing area for feeding because the transfer guide is abnormally positioned midway between the containing area for feeding and the containing area for replenishing. Thus, a large amount of sheets cannot be continuously fed. Particularly, with the arrangement described in U.S. Pat. No. 6,332,609), abnormal positioning of the transfer guide cannot be noticed unless there is a change in output from the intermediate sensor. Namely, the user cannot notice that sheet replenishment is impossible under the present conditions. This problem arises when, for example, the transfer guide has such a mechanical configuration as to be undetectable by the intermediate sensor.

SUMMARY OF THE INVENTION

The present invention provides a sheet feeding apparatus and an image forming apparatus which are able to make it known that a container for feeding cannot be replenished with sheets in a container for replenishing.

Accordingly, the present invention provides a sheet feeding apparatus comprising a sheet feeding cassette configured to comprise a first containing area in which sheets to be fed are contained, a second containing area that is adjacent to the first containing area and in which sheets for replenishing are contained, and a sheet mover that transfers the sheets contained in the second containing area to the first containing area, a first detector configured to detect whether the sheet mover is at a standby position, and an annunciator configured to, when the first detector detects that the sheet mover is not at the standby position, issue a warning that prompts return of the sheet mover to the standby position.

According to the present invention, it is possible to make it known that the container for feeding cannot be replenished with sheets in the container for replenishing.

Further features of the present invention will become apparent from the following description of exemplary embodiments (with reference to the attached drawings).

DESCRIPTION OF THE EMBODIMENTS

Hereafter, embodiments of the present invention will be described with reference to the drawings.

Figure 1:
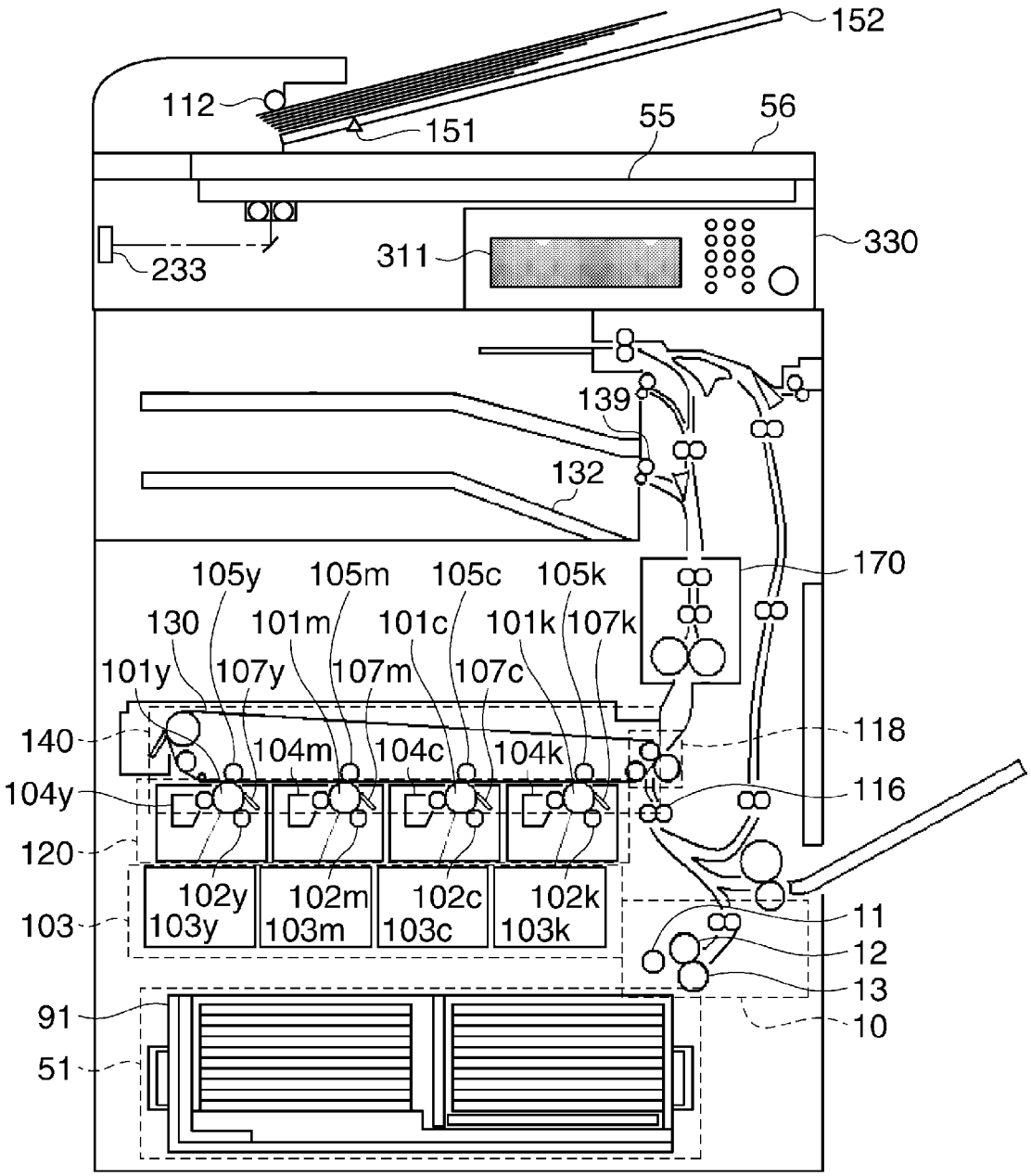
FIG. 1 is a cross-sectional view of an image forming apparatus.

FIG. 1 is a cross-sectional view of an image forming apparatus to which a sheet feeding apparatus according to a first embodiment of the present invention is applied. The image forming apparatus has four image forming units 120 (120*y*, 120*m*, 120*c*, 120*k*) for forming images of four colors, i.e. yellow (y), magenta (m), cyan (c), and black (k). The image forming apparatus also has laser scanner units 103 (103*y*, 103*m*, 103*c*, 103*k*), an intermediate transfer section 140, a fixing device 170, a sheet feeding device 51, and a feeder 10. Hereafter, when no distinction is made among colors of component elements, the same reference symbols will be used, and when a distinction is made among colors of component elements, y, m, c, and k will be added to the ends of reference symbols.

The image forming unit 120 has a photosensitive drum 101 (101*y*, 101*m*, 101*c*, 101*k*), a developing device 104 (104*y*, 104*m*, 104*c*, 104*k*), and a charging roller 102 (102*y*, 102*m*, 102*c*, 102*k*). The image forming unit 120 also has a photosensitive drum cleaner 107 (107*y*, 107*m*, 107*c*, 107*k*). The intermediate transfer section 140 includes an intermediate transfer belt 130, a primary transfer roller 105*k* for monochrome printing, and primary transfer rollers 105 (105*y*, 105*m*, 105*c*) for color printing.

Figure 2:
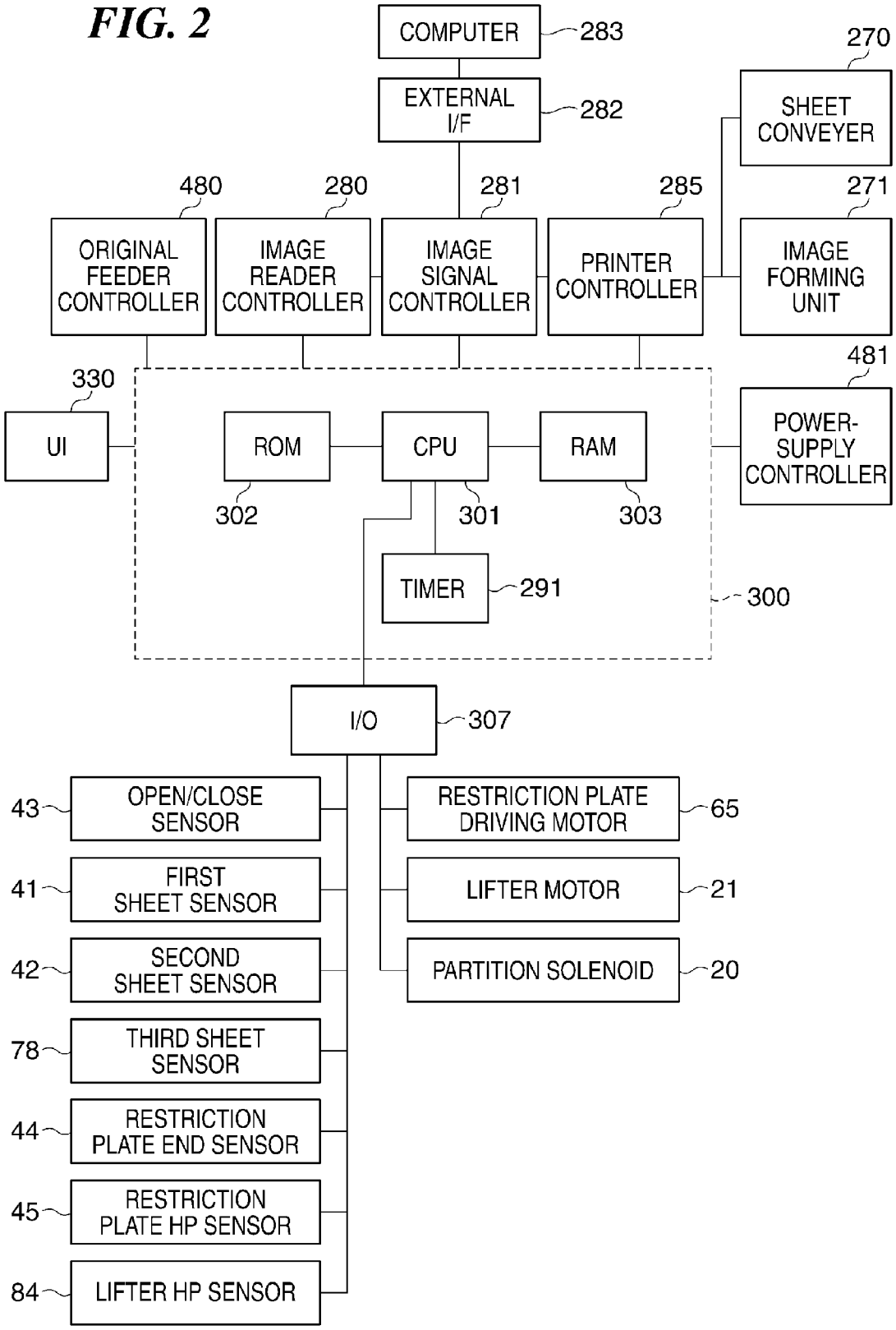
FIG. 2 is a control block diagram of the image forming apparatus.

FIG. 2 is a control block diagram of the image forming apparatus. A controller 300 has a CPU 301, a ROM 302, a RAM 303, and a timer 291. The CPU 301 controls a system of the image forming apparatus. Control programs to be executed by the CPU 301 are stored in the ROM 302. Variables for use in control and image data read by an image sensor 233 (FIG. 1) are stored in the RAM 303. The ROM 302 and the RAM 303 are connected to the CPU 301 by an address bus and a data bus. The RAM 303 is a nonvolatile memory that is able to hold saved values even if the power to the image forming apparatus is turned off. The timer 291 is able to clock time, and the CPU 301 sets time count values of the timer 291 and obtains timer measurement values.

The CPU 301 controls input of detection signals from a variety of sensors and a variety of loads such as solenoids and motors via an I/O 307. An open/close sensor 43, a first sheet sensor 41, a second sheet sensor 42, a third sheet sensor 78, and a restriction plate end sensor 44, a restriction plate HP sensor 45, a lifter home position sensor (hereinafter, referred to as the lifter HP sensor) 84 and the like are connected to the I/O 307. A restriction plate driving motor 65, a lifter motor 21, a partition solenoid 20 and the like are also connected to the I/O 307.

Referring next to FIGS. 1 and 2, a description will be given of a basic arrangement and operation of the image forming apparatus. By way of an original feeder controller 480 (FIG. 2), the CPU 301, for example, drives an original conveying roller 112 (FIG. 1) and detects the presence or absence of an original using an original sensor 151. Also, by way of an image reader controller 280 (FIG. 2), the CPU 301 detects opening and closing actions of an original pressure plate 56, and also reads an image off an original on a glass plate 55 or an image off an original fed by the original feeder controller 480 using an image sensor 233 (FIG. 1). An analog image signal output from the image sensor 233 is transferred to an image signal controller 281 (FIG. 2).

In a copying operation, the image signal controller 281 converts an analog image signal from the image sensor 233 into a digital image signal, then subjects the digital image signal to a variety of processes, converts the digital image signal into a video signal, and outputs the video signal to a printer controller 285 (FIG. 2). In a printing operation, the image signal controller 281 carries out a variety of processes on a digital image signal input from a computer 283 (FIG. 2) via an external I/F 282 (FIG. 2). The image signal controller 281 then converts the digital image signal into a video signal and outputs the video signal to the printer controller 285. Based on an instruction from the CPU 301, the printer controller 285 instructs an image forming unit 271 (FIG. 2) to form an image. The image forming unit 271 causes the image forming unit 120 to operate based on a received video signal. Also, based on an instruction from the CPU 301, the printer controller 285 instructs a sheet conveyer 270 (FIG. 2) to feed a sheet and control conveyance. Also, based on an instruction from the CPU 301, the printer controller 285 drives the fixing device 170 and provides fixing control to fix toner images on a sheet subjected to image formation.

A UI 330, which is an operating unit, is used to select a color mode in which an image is formed, indicate a status of the image forming apparatus, and give the CPU 301 an instruction to, for example, start copying. A mode setting selected here is stored in the RAM 303. When printing has not been performed for a predetermined time period, the CPU 301 shifts the image forming apparatus into a power-saving mode by way of a power controller 481. In the power-saving mode, the CPU 301 turns off an LED backlight of a display 311 (FIG. 1) of the UI 330 and also stops supplying power to various driving loads.

Referring next to FIGS. 1 and 2, a description will be given of a basic image forming operation. Upon receiving print setting instructions such as a color mode and numerics through, for example, the display 311 of the UI 330 and detecting opening or closing of the original pressure plate 56 or placement of an original on an original tray 152 (FIG. 1) via the original feeder controller 480 or the image reader controller 280, the CPU 301 performs an operation to prepare for printing. In the operation to prepare for printing, the CPU 301 starts controlling the temperature of the fixing device 170. Further, in accordance with a color mode designated using the UI 330, the CPU 301 starts to switch the photosensitive drum 101 and the intermediate transfer section 140 between an abutting state and a separating state and drivingly control a polygon motor in the laser scanner unit 103. A detailed description will be given later of how the intermediate transfer section 140 is switched between the abutting state and the separating state, as well as the operation to prepare for printing.

In response to an instruction to start a printing operation, the CPU 301 starts reading an original by way of the original feeder controller 480. Specifically, the CPU 301 drives the original conveying roller 112 to convey the original from the original tray 152 and also and causes the image sensor 233 to read an image on the original during conveyance. The image data on the original read by the image sensor 233 is output to the image signal controller 281. Reading is continued until originals on the original tray 152 run out.

When switching of the intermediate transfer section 140 between the abutting state and the separating state is completed, the CPU 301 controls the image forming unit 120 through the image forming unit 271 to start an operation to form an image of image data stored in the RAM 303. In each image forming unit 120, after a surface of the photosensitive drum 101 is charged, laser light output from the laser scanner unit 103 forms a latent image on the photosensitive drum 101. The latent image thus formed is developed on the photosensitive drum 101 by toner in the developing device 104. After that, a primary transfer voltage is applied to the toner image developed on the photosensitive drum 101 by the primary transfer roller 105, and the toner image is transferred to the intermediate transfer belt 130. The toner image transferred to the intermediate transfer belt 130 is led to the secondary transfer section 118 through rotation of the intermediate transfer belt 130.

The feeder 10 (FIG. 1), which has a sheet-feeding pickup roller 11, a sheet feeding roller 12, a retarding roller 13, and so forth, draws a sheet from a sheet feeding cassette 91 of the sheet feeding device 51 and feeds the same to the secondary transfer section 118. The CPU 301 controls the feeder 10 and sheet conveyance through the sheet conveyer 270 in synchronization with the timing with which a toner image on the intermediate transfer belt 130 arrives at the secondary transfer section 118. Specifically, the CPU 301 runs conveying motors, not shown, which are driving sources for the sheet-feeding pickup roller 11, the sheet feeding roller 12, registration rollers 116, and sheet discharging rollers 139 in synchronization with the above timing. In response to this, the sheet-feeding pickup roller 11 is rotatively driven to feed and convey sheets one by one from the sheet feeding cassette 91. As sheets are fed and conveyed one by one, the level of an upper surface of a sheet bundle stacked in the sheet feeding cassette 91 is gradually lowered. Accordingly, the CPU 301 moves up a lifter plate 35 by driving a lifter motor 21 so that the level of the upper surface of the sheet bundle in the sheet feeding cassette 91 can be kept at a stable level.

In the above described manner, by applying a transfer voltage to a sheet that has arrived at the secondary transfer section 118, a toner image is transferred to the sheet. After the transfer, the sheet is conveyed to the fixing device 170. The fixing device 170 fixes the toner image to the sheet by application of heat. After that, the sheet is discharged onto a discharged-sheet tray 132 by the sheet discharging rollers 139. It should be noted that the above image forming operation is merely an example, and the present invention should not be limited to the above arrangement and operations.

Referring next to FIGS. 3A, 3B, and 4A to 4C, a detailed description will be given of the sheet feeding device 51. FIGS. 3A, 3B, and 4A to 4C, which are longitudinal cross-sectional views of the sheet feeding device 51, show different states. The sheet feeding device 51 has the sheet feeding cassette 91. The sheet feeding cassette 91 has a first sheet containing area 31 (hereafter referred to as "the first containing area 31") and a second sheet containing area (hereafter referred to as "the second containing area 32"), which are housing areas where sheets are contained and configured as an integral unit. The sheet feeding device 51 has what is called a tandem cassette feeding arrangement. In each of the first and second containing areas 31 and 32, a sheet bundle of a small size such as an A4 size and a letter size is contained.

In the first containing area 31, a plurality of sheets to be fed from the sheet feeding device 51 to the secondary transfer section 118 by the feeder 10 is contained. The sheets in the first containing area 31 are successively fed one by one from the uppermost one. The second containing area 32 is disposed adjacent to the first containing area 31 in a horizontal direction, and houses sheets to replenish the first containing area 31. When sheets in the first containing area 31 have ran out, a sheet bundle in the second containing area 32 is transferred in its entirety to the first containing area 31 to replenish the first containing area 31 with the sheet bundle. After that, sheet feeding from the first containing area 31 is allowed to be resumed, enabling continuous printing of an amount exceeding the loading capacity of the first containing area 31.

Figure 3A:
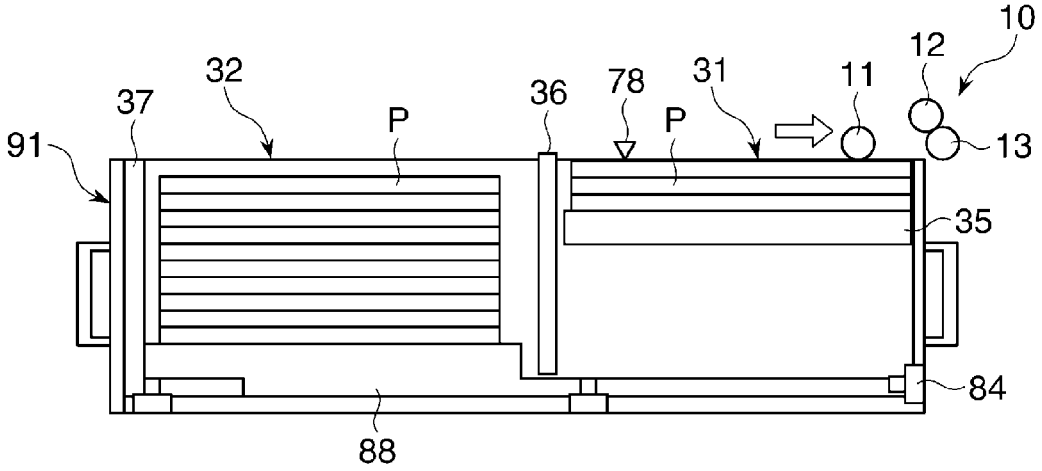
FIGS. 3A and 3B are longitudinal cross-sectional views of a sheet feeding apparatus.

In the first containing area 31, the lifter plate 35, which is supported to be able to move up and down a stacked sheet bundle, is placed. The lifter HP sensor 84 is disposed in a lower part of the sheet feeding cassette 91 on the first containing area 31 side. The sheet-feeding pickup roller 11 of the feeder 10 is disposed above the lifter plate 35, is supported so as to rotationally move by an arm (not shown) which is able to rotationally move, and is configured to draw sheets P stacked on the lifter plate 35. FIG. 3A shows a state where sheets are fed. Drawn sheets P are conveyed by the sheet feeding roller 12, and when two or more sheets P are drawn, underlying sheets among the second and subsequent sheets P are moved back to the sheet feeding cassette 91 through a separating action of the sheet feeding roller 12 and the retarding roller 13. The CPU 301 controls the operation of the lifter motor 21 to move up the lifter plate 35 until the third sheet sensor 78 detects sheet presence. As a result, the uppermost sheet P of a sheet bundle on the lifter plate 35 always comes into abutment with the sheet-feeding pickup roller 11 in a stable manner.

Figure 3B:
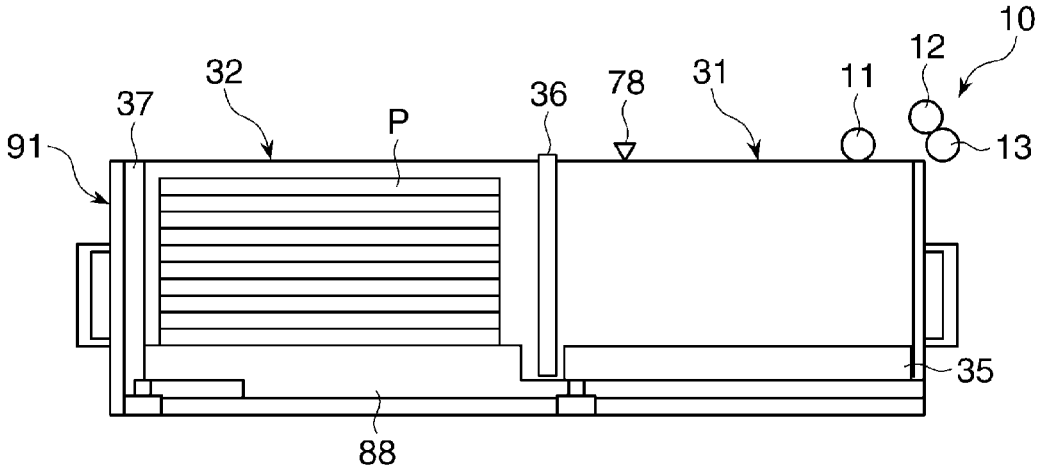

FIG. 3B shows a state where the lifter 35 moves down to a lower end after the third sheet sensor 78 detects sheet absence. When all the sheets P have been fed from the first containing area 31, the third sheet sensor 78 detects that sheets ran out, that is, sheet absence. In response to the detection of sheet absence, the sheet convening unit 270 drives the lifter motor 21 to move down the lifter plate 35 until the lifter HP sensor 84 is detected.

The sheet feeding device 51 has an immovable set tray 88 a part of which extends from the second containing area 21 toward the first containing area 31. The set tray 88 is disposed at a bottom of the second containing area 32. A sheet bundle movement restriction plate 37 (sheet mover), which is supported so as to be able to slide along the set tray 88 toward the first containing area 31 is placed in the second containing area 32. The sheet bundle movement restriction plate 37 (hereafter abbreviated sometimes as "the restriction plate 37") is configured to be able to slide in a direction in which the first and second containing areas 31 and 32 are placed side by side (a horizontal direction in FIG. 3A).

An arm member 36, which is a partition between sheet bundles in the first and second containing areas 31 and 32, is placed midway between the first and second containing areas 31 and 32. The arm member 36 is configured to be driven by the partition solenoid 20 and movable to a partitioning portion and an opening position. The partitioning position is a position at which the arm member 36 acts a partition between the first containing area 31 and the second containing area 32, and the opening position is a position at which the arm member 32 retracted from the partitioning position opens the first containing area 31 and the second containing area 32 to each other. A position of the arm member 36 in FIGS. 3A and 3B is the partitioning position, and this is a home position of the arm member 36.

Figure 5A:
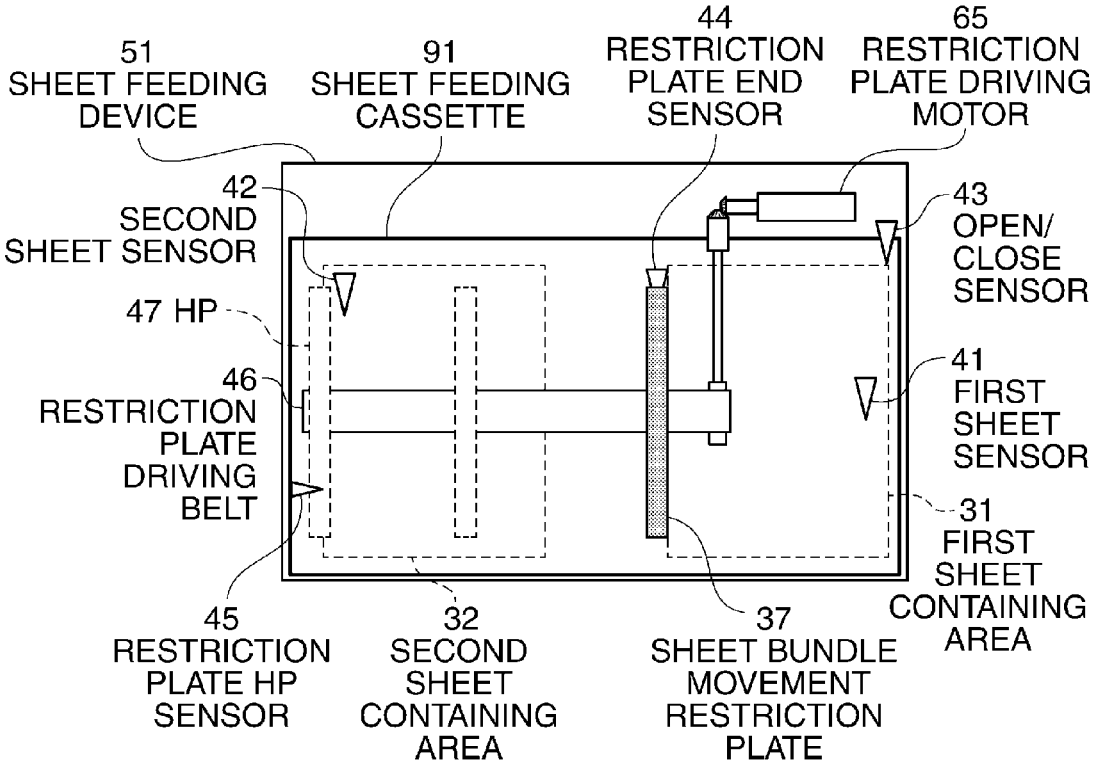
FIGS. 5A and 5B are top views of the sheet feeding apparatus.
Figure 5B:
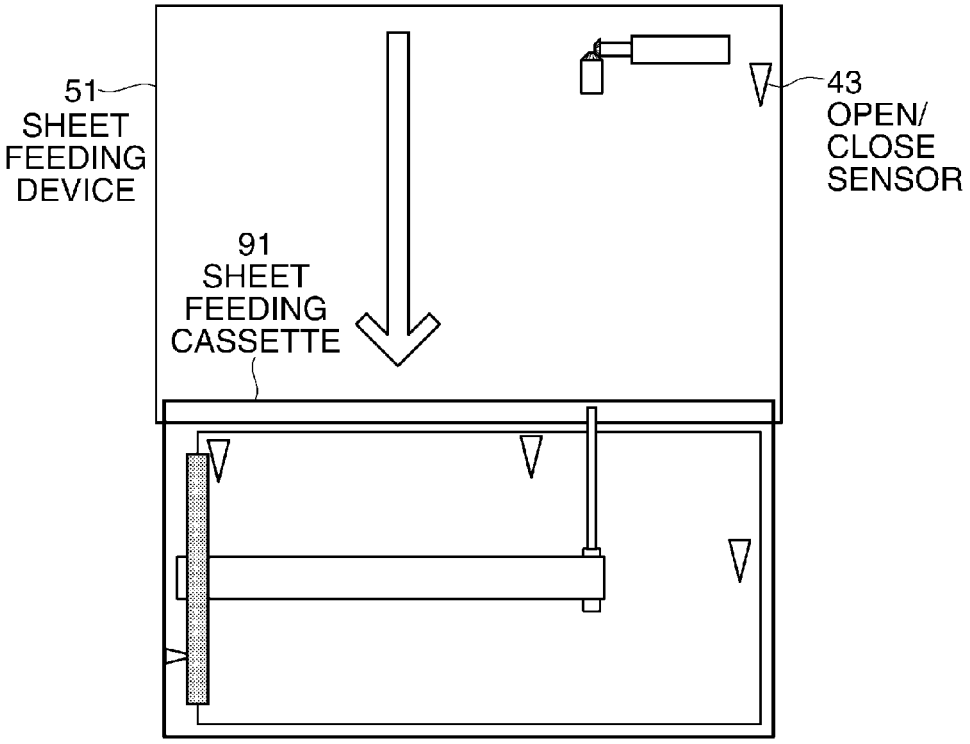

FIGS. 5A and 5B are top views of the sheet feeding device 51. The sheet feeding cassette 91 is supported by the sheet feeding device 51 such that it is able to be installed in and pulled out from an installation space in a main body of the sheet feeding device 51. FIGS. 5A and 5B show a state where the sheet feeding cassette 91 is installed in the sheet feeding device 51, and a state where the sheet feeding cassette 91 is pulled out from the sheet feeding device 51, respectively. Pulling-out and installing of the sheet feeding cassette 91 may be referred to as "opening and closing". The pulled-out state is an opened state where the sheet feeding cassette 91 is ready to house a new sheet. The installed state is a closed state where feeding of a sheet from the first containing area 31 is possible. The opened and closed states of the sheet feeding cassette 91 are detected by the open/close sensor 43 (third detector).

A position of the sheet bundle movement restriction plate 37 in FIG. 3A is an initial standby position, that is, a home position (HP) 47 (see FIG. 5A). As shown in FIG. 5A, whether or not the restriction plate 37 is at the HP 47 is detected by the restriction plate HP sensor 45, and when the detection result is ON, the CPU 301 determines that the restriction plate 37 is at the HP 47. The restriction plate 37 is supported in the sheet feeding cassette 91 such that it is able to slide by a restriction plate driving belt 46 in a direction in which the first and second containing areas 31 and 32 are placed side by side (a horizontal direction n FIG. 5A). The restriction plate driving belt 46 is driven by a restriction plate driving motor 65 (FIG. 2), which is controlled by the sheet conveyer 270, to rotationally move. By moving from the HP 47 toward the first containing area 31, the restriction plate 37 itself pushes and collectively transfers a sheet bundle placed in the second containing area 32 to the first containing area 31.

Figure 4A:
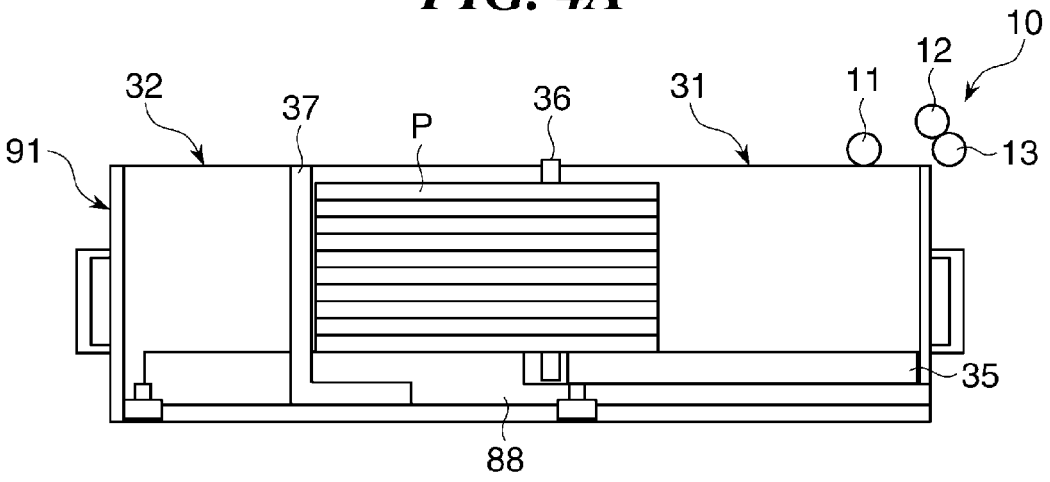
FIGS. 4A to 4C are longitudinal cross-sectional views of the sheet feeding apparatus.
Figure 4B:
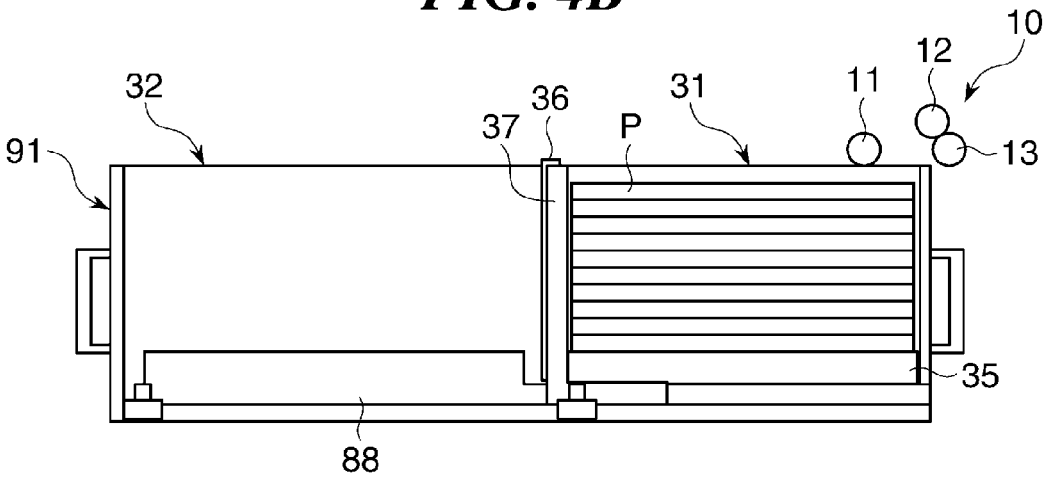
Figure 4C:
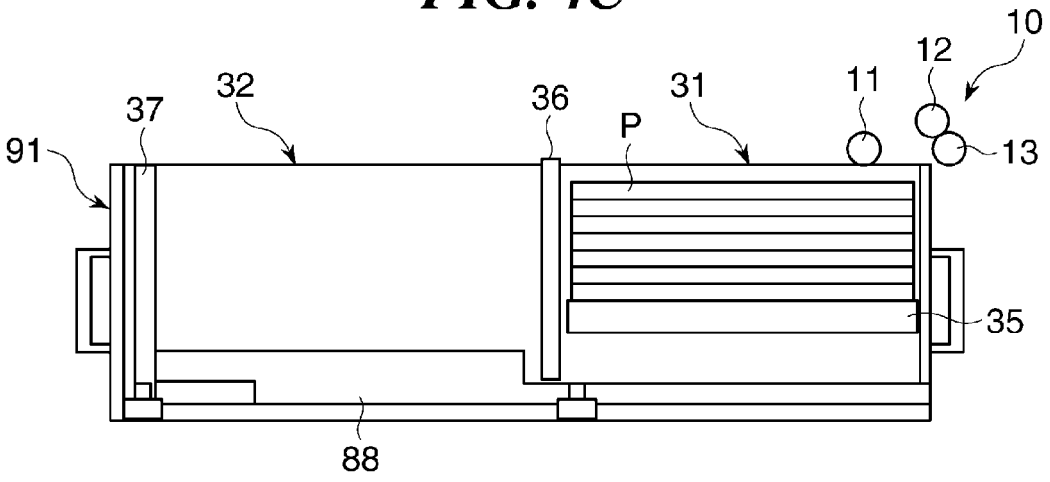

FIGS. 4A to 4C show the sheet feeding device 51 during transfer of a sheet bundle, after completion of the transfer, and after the start of lift-up, respectively. During a sheet feeding operation or before transfer of a sheet bundle is started, the arm member 36 lies at a home position (FIGS. 3A and 3B). During transfer of a sheet bundle by the restriction plate 37, the arm member 36 retracts from the partitioning position to the opening position (FIG. 4A). After the restriction plate 37 finishes sliding so as to transfer the sheets (FIG. 4B), it backs to the HP 47. When the restriction plate 37 returns to the HP 47 (FIG. 4C), the lifter plate 35 moves up to bring the uppermost sheet in the first containing area 31 into abutment against the sheet-feeding pickup roller 11, thus completing sheet bundle transfer control. The sheet bundle transfer control will be described later in detail with reference to FIGS. 5A to 5C and flowcharts of FIGS. 6 to 8.

As shown in FIG. 5A, the second sheet sensor 42 is placed in the second containing area 32 to detect the presence or absence of sheets in the second containing area 32. The first sheet sensor 41 is placed in the first containing area 31 to detect the presence or absence of sheets in the first containing area 31. The restriction plate end sensor 44 is placed on the first containing area 31 side in the sheet feeding cassette 91 and at a position where the restriction plate 37 lies when movement of the restriction plate 37 in a forward direction for the purpose of transferring a sheet bundle ends.

The CPU 301 controls the restriction plate 37 based on results of detection by the restriction plate HP sensor 45 and the restriction plate end sensor 44. The restriction plate HP sensor 45 is at the HP 47 of the restriction plate 37. To start sheet transfer, the restriction plate 37 needs to be at the HP 47. When the restriction plate end sensor 44 detects the restriction plate 37, movement of the restriction plate 37 in the forward direction ends. On the other hand, to properly house new sheets in the second containing area 32 with the sheet feeding cassette 91 open, the restriction plate 37 needs to be at the HP 47.

The first sheet sensor 41, the second sheet sensor 42, the restriction plate end sensor 44, and the restriction plate HP sensor 45 are placed and configured to perform the detecting function even when the sheet feeding cassette 91 is open. It should be noted that the sheet feeding cassette 91 has a considerable cost advantage because the first containing area 31 and the second containing area 32 are configured as an integral unit, and only a small number of component elements such as a pull-out guide (not shown) are needed. This mechanical configuration, however, is merely an example, and the present invention should not limited to this.

Figure 6:
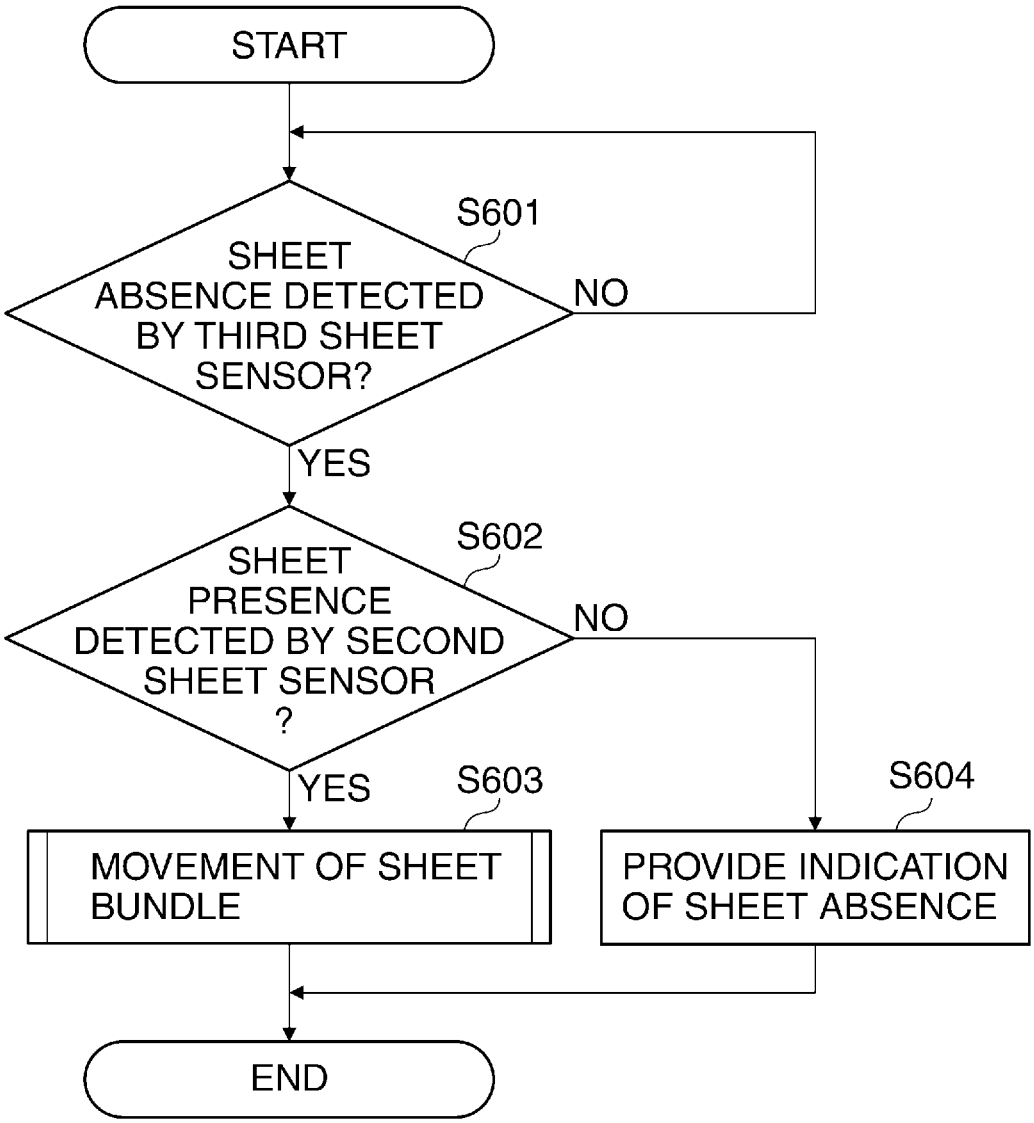
FIG. 6 is a flowchart showing a process to control transfer of a sheet bundle.

FIG. 6 is a flowchart showing a process for sheet bundle transfer control during an image forming operation. This process is started in response to an instruction to start an image forming operation and carried out at regular time intervals.

First, the CPU 301 determines whether or not the third sheet sensor 78 has detected that all the sheets P have been fed from the first containing area (step S301) and repeatedly carries out this determination until all the sheets P have been fed. When it is detected that all the sheets P have been fed from the first containing area 31, the CPU 301 determines whether or not "sheets are present in the second containing area 32", that is, whether or not there are sheets in the second containing area 32 based on a result of detection by the second sheet sensor 42 (step S602). As a result of this determination, when there are sheets in the second containing area 32, it is possible to transfer a sheet bundle, and hence the CPU 301 carries out a sheet bundle moving operation, that is, a sheet bundle transfer process so as to transfer sheets contained in the second containing area 32 to the first containing area 31 (step S603). This sheet bundle transfer process will be described later with reference to FIG. 8. On the other hand, when there is no sheet in the second containing area 32, sheet replenishment by transferring a sheet bundle is impossible, and hence the CPU 301 provides an indication of sheet absence (step S604).

Figure 9A:
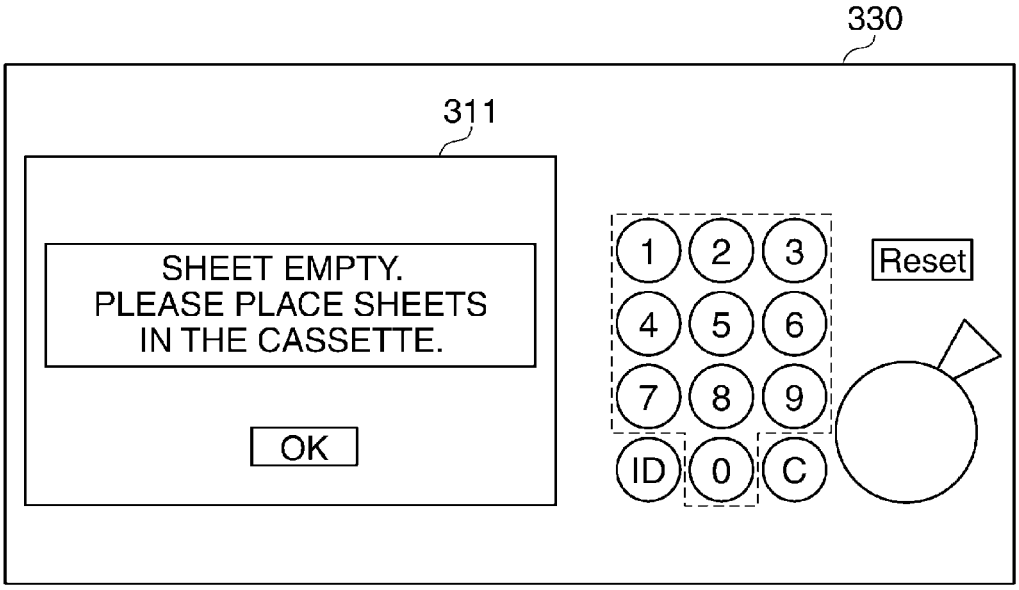
FIGS. 9A to 9D are views showing exemplary displays on a display of a UI.

FIGS. 9A to 9D are views showing exemplary displays on the display 311 of the UI 330. FIG. 9A shows an exemplary indication of sheet absence provided in the step S604. For example, the CPU 301 displays, on the display 311 of the UI 330, a message that prompts placement of sheets because sheets have ran out. After the processes in the step S603 and S604, the process in FIG. 6 is brought to an end.

Figure 7:
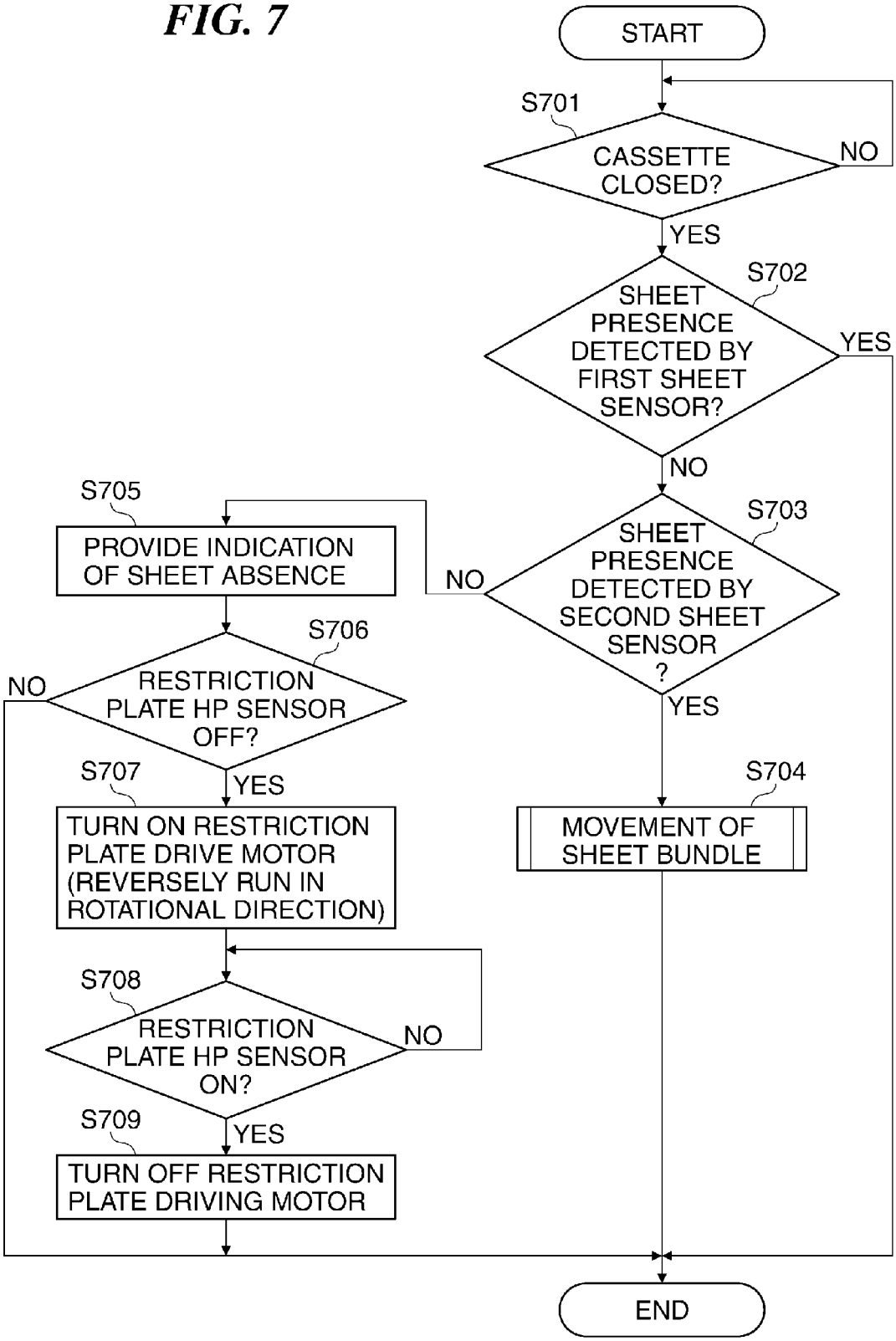
FIG. 7 is a flowchart showing a process to control transfer of a sheet bundle.

FIG. 7 is a flowchart showing a process for sheet bundle transfer control with the sheet feeding cassette 91 open. This process is started when the open/close sensor 43 detects that the sheet feeding cassette 91 is open.

First, based on a result of detection by the open/close sensor 43, the CPU 301 determines whether or not the sheet feeding cassette 91 has been closed (step S701) and repeatedly makes this determination until the sheet feeding cassette 91 has been closed. When the sheet feeding cassette 91 has been closed, the CPU 301 determines whether or not "sheets are present in the first containing area 31", that is, whether or not there are sheets in the first containing area 31 based on a result of detection by the first sheet sensor 41 (step S702). As a result of this determination, when there are sheets in the first containing area 31, it is unnecessary to replenish the first containing area 31 with sheets, and hence the CPU 301 ends the process in FIG. 7.

On the other hand, when there is no sheet in the first containing area 31, the CPU 301 determines whether or not "sheets are present in the second containing area 32", that is, whether or not there are sheets in the second containing area 32 based on a result of detection by the second sheet sensor 42 (step S703). When there are sheets in the second containing area 32, the CPU 301 carries out a sheet bundle moving operation, that is, a sheet bundle transfer process so as to transfer sheets contained in the second containing area 32 to the first containing area 31 (step S704) and ends the process in FIG. 7. This sheet bundle moving operation will be described later with reference to FIG. 8.

On the other hand, when there is no sheet in the second containing area 32, it is impossible to transfer a sheet bundle. Accordingly, the CPU 301 carries out processes in step S705 and subsequent steps. First, the CPU 301 provides a sheet-absence indication on the display 311 of the UI 330 as illustrated in FIG. 9A (step S705). Next, the CPU 301 determines whether or not the result of detection by the restriction plate HP sensor 45 is OFF (step S706). As a result of this determination, when the result of detection by the restriction plate HP sensor 45 is ON, the CPU 301 determines that the restriction plate 37 has retracted to the HP 47 and thus ends the process in FIG. 7.

On the other hand, when the result of detection by the restriction plate HP sensor 45 is OFF, the CPU 301 reversely drives the restriction plate driving motor 65 (step S707). This aims to retract the restriction plate 37, which has moved to the restriction plate end sensor 44, to the HP 37. The CPU 301 then determines whether or not the result of detection by the restriction plate HP sensor 45 has turned ON (step S708), and repeatedly makes this determination until the result of detection by the restriction plate HP sensor 45 has turned ON. When the result of detection by the restriction plate HP sensor 45 has turned ON, this means that the restriction plate 37 has retracted to the HP 47, and hence the CPU 301 stops driving the restriction plate driving motor 65 (step S709) and ends the process in FIG. 7.

Figure 8:
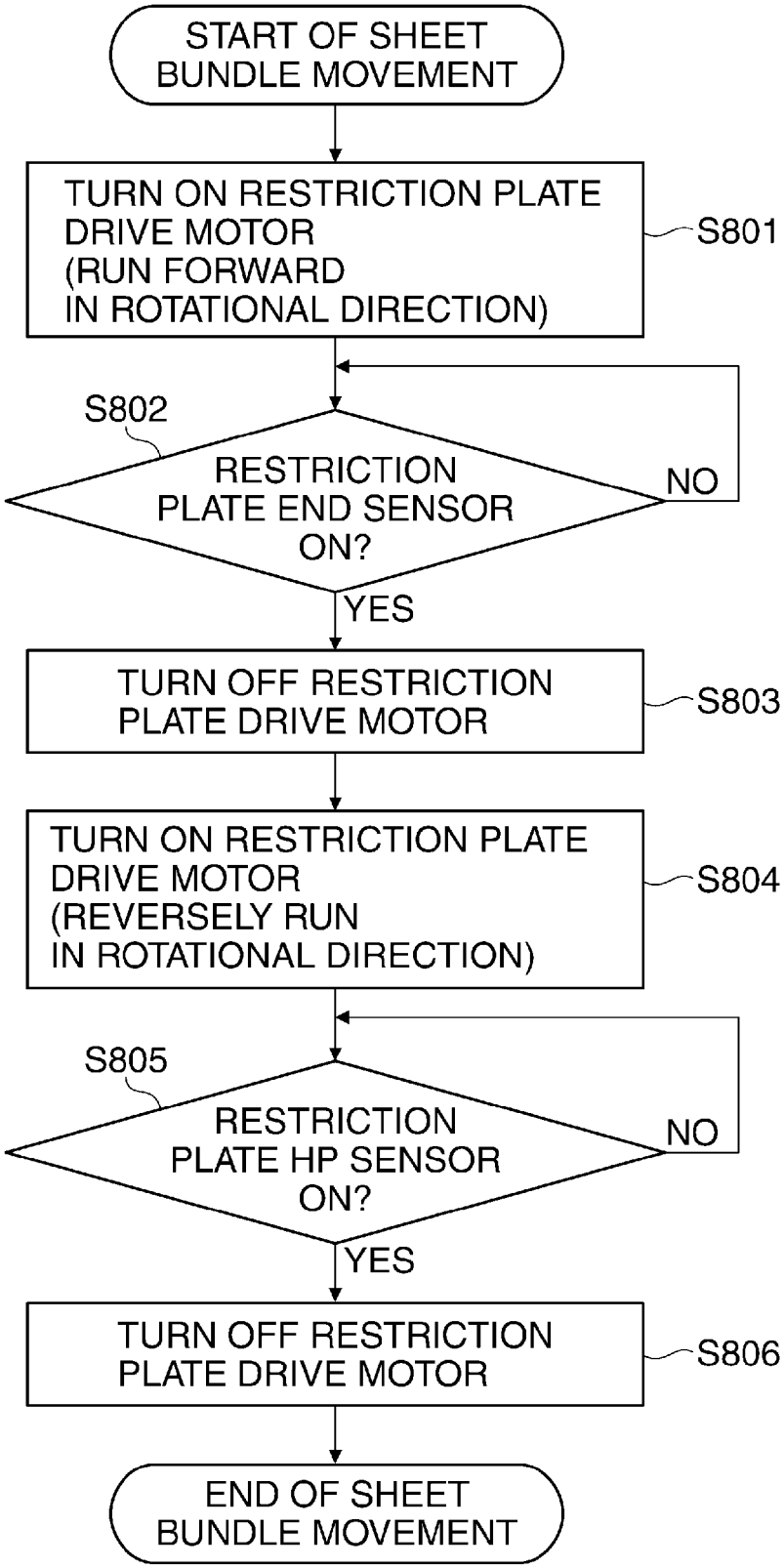
FIG. 8 is a flowchart showing a process of a sheet bundle moving operation.

FIG. 8 is a flowchart showing a process for the sheet bundle moving operation. This process is carried out in the step S603 in FIG. 6 and the step S704 in FIG. 7.

First, the CPU 301 starts driving the restriction plate driving motor 65 forward (step S801). As a result of this, the restriction plate 37 moves from the HP 47, and transfer of sheets is started. Next, the CPU 301 determines whether or not the result of detection by the restriction plate end sensor 44 has turned ON (step S802), and repeatedly makes this determination until the result of detection by the restriction plate end sensor 44 has turned ON. When the result of detection by the restriction plate end sensor 44 has turned ON, this means that the restriction plate 37 has moved to a replenishing position, and hence the CPU 301 stops driving the restriction plate driving motor 65 (step S803). Thus, the first containing area 31 is replenished with the sheet bundle contained in the second containing area 32.

Then, the CPU 301 reversely drives the restriction plate driving motor 65 (step S804). This aims to put the restriction plate 37, which has moved to the restriction plate end sensor 44, back to the HP 47. The CPU 301 then determines whether or not the result of detection by the restriction plate HP sensor 45 has turned ON (step S805), and repeatedly makes this determination until the result of detection by the restriction plate HP sensor 45 has turned ON. When the result of detection by the restriction plate HP sensor 45 has turned ON, this means that the restriction plate 37 has retracted to the HP 47, and hence the CPU 301 stops driving the restriction plate driving motor 65 (step S806) and ends the process in FIG. 8.

According to the process in FIG. 8, when sheets contained in the first containing area 31 have ran out, and sheets are contained in the second containing area 32, transfer of a sheet bundle through movement of the restriction plate 37 is carried out, and hence the first containing area 31 is automatically replenished with sheets. Also, when movement of the restriction plate 37 for the purpose of transfer of a sheet bundle ends, the restriction plate 37 retracts to the HP 47, and this automatically returns the sheet feeding cassette 91 to a state where it is ready to be replenished with sheets.

Figure 10A:
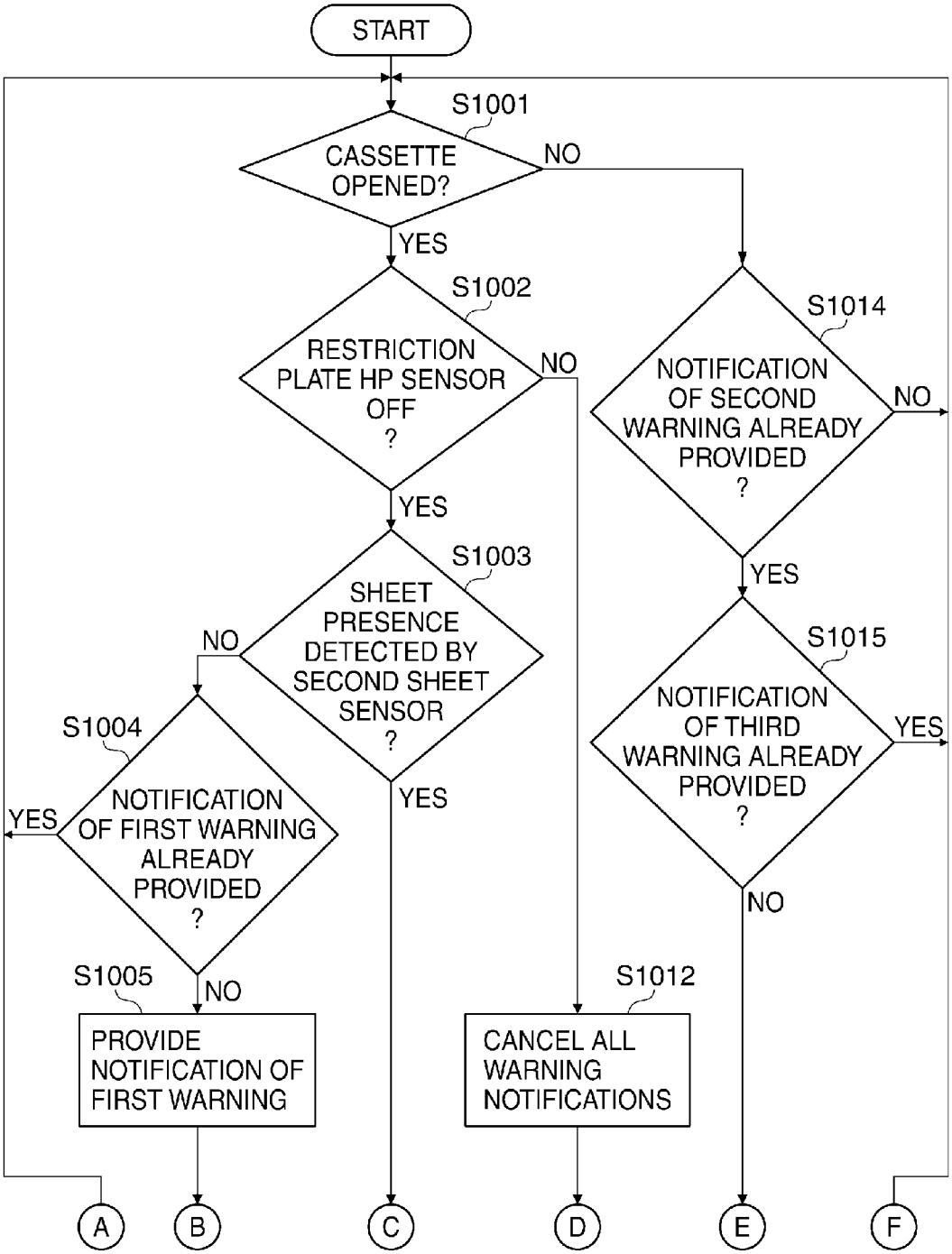
FIGS. 10A and 10B are flowcharts showing a warning process.
Figure 10B:
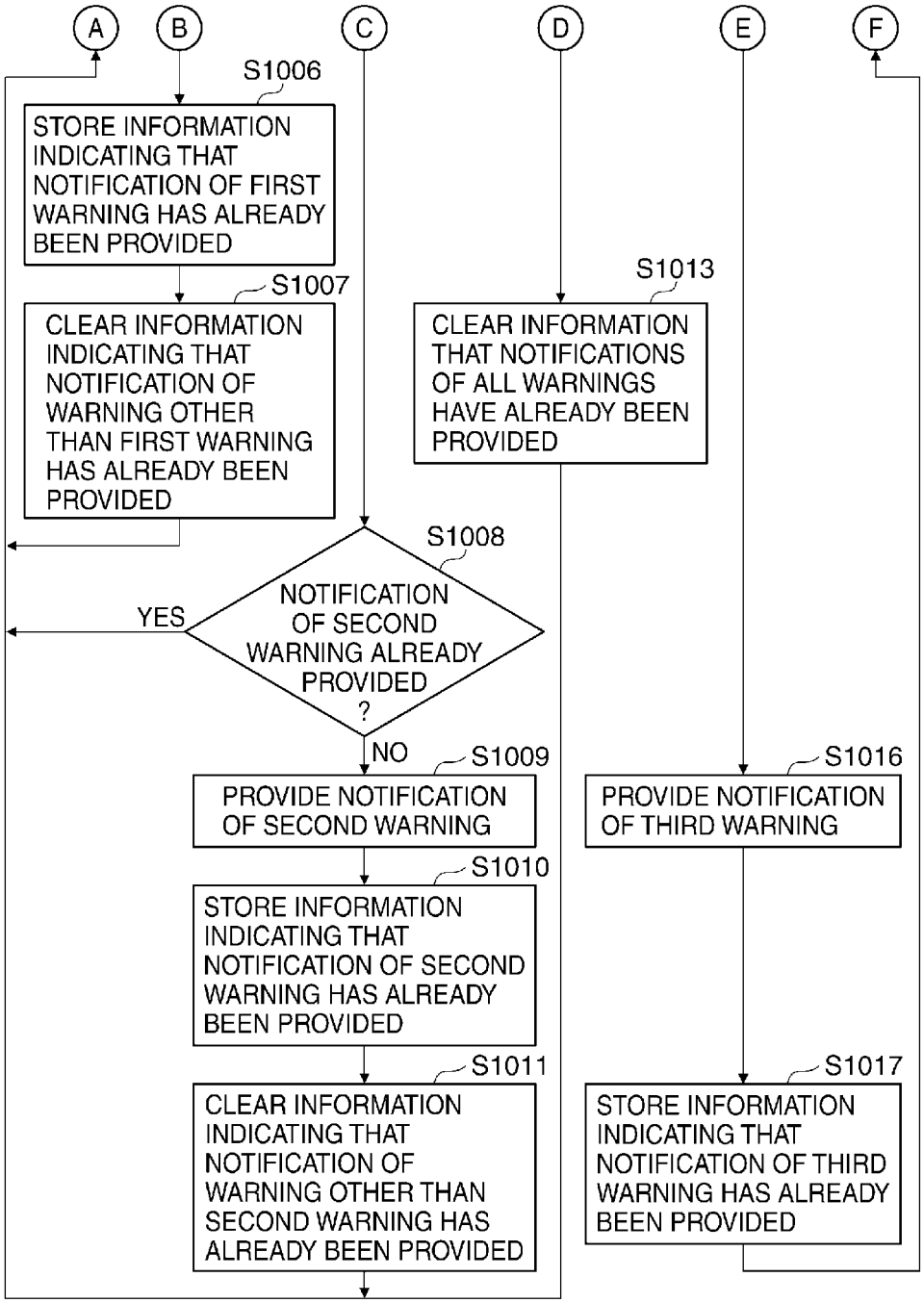

FIGS. 10A and 10B are flowcharts showing a warning process. This process is started in response to turning-on of the power to the image forming apparatus and carried out at regular time intervals.

First, based on a result of detection by the open/close sensor 43, the CPU 301 determines whether or not the sheet feeding cassette 91 is open (step S1001). As a result of this determination, when the sheet feeding cassette 91 is open, the CPU 301 determines whether or not the result of detection by the restriction plate HP sensor 45 is OFF (step S1002). As a result of this determination, when the result of detection by the restriction plate HP sensor 45 is OFF, the restriction plate 37 is not at the HP 47. In this case, the sheet feeding cassette 91 is open, and the restriction plate 37 is out of the HP 47. As an example of this case, a case in which a user has pulled out the sheet feeding cassette 91 and manually moved the restriction plate 37 to a position out of the HP 47 is imagined. In this case, sheets in the second containing area 32 cannot be transferred, and hence a warning needs to be issued.

Accordingly, first, the CPU 301 determines whether or not "sheets are present in the second containing area 32", that is, whether or not there are sheets in the second containing area 32 based on a result of detection by the second sheet sensor 42 (step S1003). As a result of this determination, when there is no sheet in the second containing area 32, the CPU 301 determines whether or not notification of a first warning has already been provided (step S1004).

A description will now be given of warnings that may be issued in the process in FIGS. 10A and 10B. The warnings include first to third warnings. Each warning has a meaning of notifying a user that the restriction plate 37 is not at the HP 47. In the process in FIGS. 10A and 10B, the CPU 301 and the UI 330 cooperate with each other to act as an annunciator of the present invention.

Figure 9B:
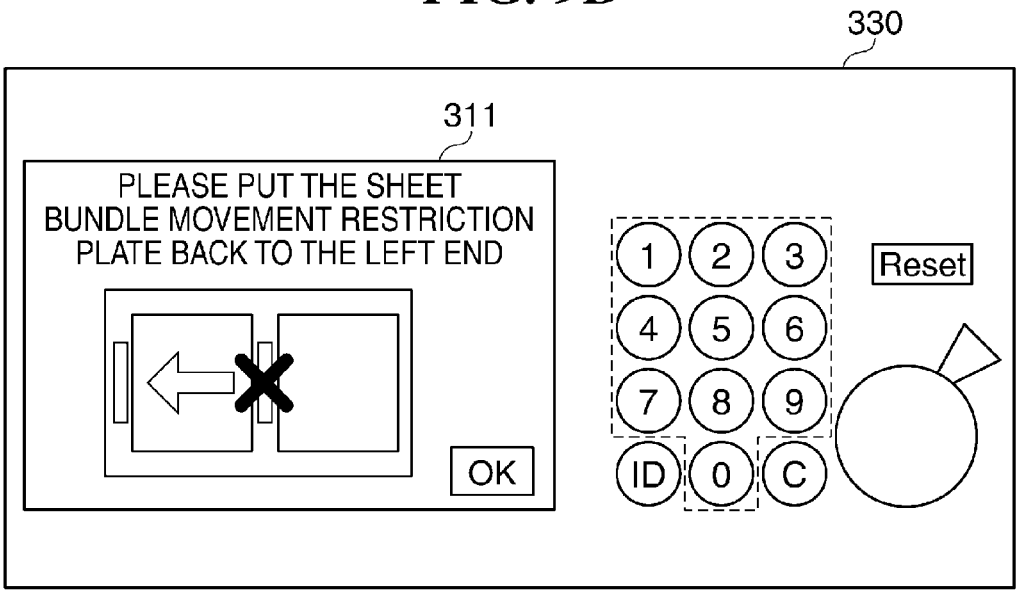
Figure 9C:
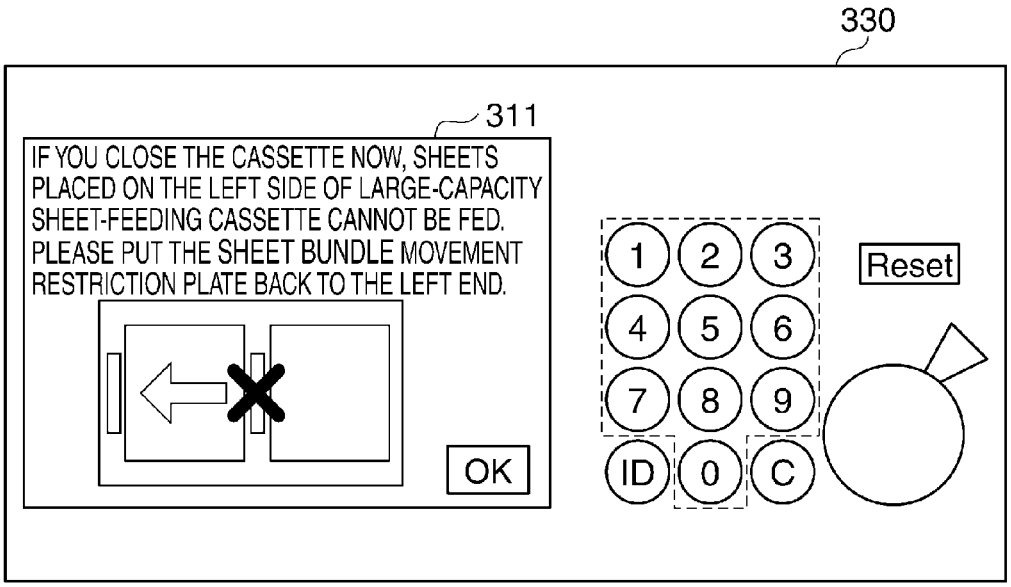

The first warning is to prompt return of the restriction plate 37 to the HP 47 and implemented by, for example, displaying a message on the display 311 of the UI 330 as illustrated in FIG. 9B. The second warning is to provide notification that sheets cannot be transferred to the first containing area 31 using the restriction plate 37 even if the sheet feeding cassette 91 is closed under the present conditions, and also prompt return of the restriction plate 37 to the HP 47. This is implemented by, for example, displaying a message on the display 311 as illustrated in FIG. 9C.

Figure 9D:
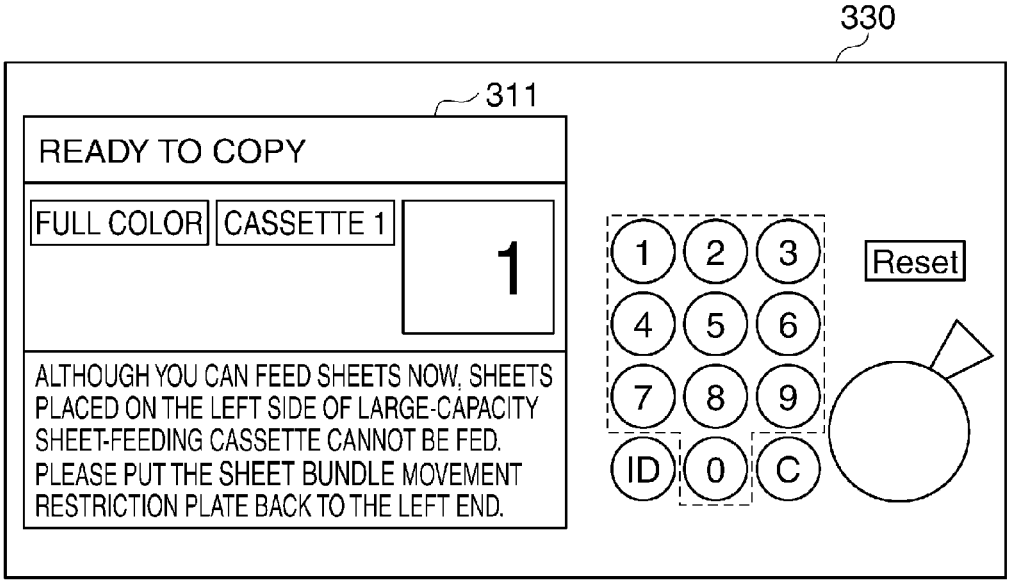

The third warning is to provide notification that sheets cannot be transferred to the first containing area 31 using the restriction plate 37 although transfer of sheets from the first containing area 31 is possible, and also prompt return of the restriction plate 37 to the HP 47. This is implemented by, for example, displaying a message on the display 311 as illustrated in FIG. 9D.

When any of the first to third warnings is issued, information indicating a corresponding warning notification has been issued is stored in the RAM 303. It should be noted that each of the above warnings may be implemented by displaying a predetermined mark, not a message. Alternatively, each of the above warnings may be implemented by sound and should not always be implemented by displaying something.

In the step S1004, the CPU 301 determines whether or not notification of the first warning has already been provided based on whether or not the corresponding information is stored in the RAM 303. When the CPU 301 determines that the first warning has already been issued, the process returns to the step S1001. On the other hand, when the first warning has not yet been issued, the CPU 301 provides notification of the first warning (FIG. 9B) (step S1005) and stores, in the RAM 303, information indicating that notification of the first warning has already been provided (step S1006). Further, when information indicating that notification of a warning other than the first warning has already been provided is stored in the RAM 303, the CPU 303 clears this information (step S1007), followed by the process returning to the step S1001.

On the other hand, as a result of the determination in the step S1003, when there are sheets in the second containing area 32, the sheet feeding cassette 91 is open, the restriction plate 37 is not at the HP 47, and moreover, sheets are contained in the second containing area 32. As an example of this case, a case in which a user has pulled out the sheet feeding cassette 91, manually moved the restriction plate 37 to a position corresponding to the end of transfer, and placed sheets in the second containing area 32 is imagined. In this case, sheets in the second containing area 32 cannot be transferred to the first containing area 31. Thus, the CPU 301 determines whether or not notification of the second warning has already been provided based on whether or not the corresponding information is stored in the RAM 303 (step S1008). When the CPU 301 determines that notification of the second warning has already been provided, the process returns to the step S1001. On the other hand, when notification of the second warning has not yet been provided, the CPU 301 provides notification of the second warning (FIG. 9C) (step S1009) and stores, in the RAM 303, information indicating that notification of the second warning has already been provided (step S1010). Further, when information indicating that notification of a warning other than the second warning has already been provided is stored in the RAM 303, the CPU 303 clears this information (step S1011), followed by the process returning to the step S1001.

As a result of the determination in the step S1001, when the sheet feeding cassette 91 is closed, the CPU 301 determines whether or not notification of the second warning has already been provided based on whether or not the corresponding information is stored in the RAM 303 (step S1014). As a result of this determination, when notification of the second warning has already been provided, the CPU 301 determines whether or not notification of the third warning has already been provided based on whether or not the corresponding information is stored in the RAM 303 (step S1015). When the CPU 301 determines that notification of the third warning has already been provided, the process returns to the step S1001.

On the other hand, when notification of the third warning has not yet been provided, this means that the sheet feeding cassette 91 is closed, the restriction plate 37 is not at the HP 47, and moreover, no sheet is contained in the second containing area 32. As an example of this case, a case in which a user closes the sheet feeding cassette 91 without putting the restriction platter 37 back to the HP 47 after notification of the second warning is provided is imagined. Namely, a case in which a user has pulled out the sheet feeding cassette 91, manually moved the restriction guide 37 to a position corresponding to the end of transfer, placed sheets in the second containing area 32, and installed the sheet feeding cassette 91 as it is imagined. In this case, although feeding of sheets from the first containing area 31 is possible, sheets in the second containing area 32 cannot be transferred to the first containing area 31 when sheets in the first containing area 31 run out, and it is thus necessary to issue a warning.

Accordingly, the CPU 301 provides notification of the third warning (FIG. 9D) (step S1016) and stores, in the RAM 303, information indicating that notification of the third warning has already been provided (step S1017), followed by the process returning to the step S1001.

On the other hand, as a result of the determination in the step S1014, when notification of the second warning has not yet been provided, the process returns to the step S1001. In this case, notification of the first warning may have already been provided, but the processes in the step S1008 and the subsequent steps have not been carried out yet, and no sheets are stacked in the second containing area 32 because notification of the second warning has not yet been provided. Therefore, sheets have not yet been placed in the second containing area 32 with the restriction guide 37 already moved to a position corresponding to the end of transfer, and thus no warning is issued.

As a result of the determination in the step S1002, when the result of detection by the restriction plate HP sensor 45 is ON, the restriction plate 37 has been put back to the correct position (the HP 47), and hence the CPU 301 stops all warning notifications being provided (step S1012). Thus, warning messages are deleted from the display 311 of the UI 330. The CPU 301 clears information stored in the RAM 303 and indicating that notification of a warning has been provided (step S1013), followed by the process returning to the step S1001.

In the above described way, the CPU 301 provides notification that there is a possibility of abnormal stacking in the sheet feeding device 51 by the user, prompts correct sheet stacking, and prompts return to a state in which it is possible to continuously feed a large amount of sheets.

According to the present embodiment, when the restriction plate 37 is brought into a state of being not positioned at the HP 47 with the sheet feeding cassette 91 open, the first warning or the second warning is issued, and the user is notified that the restriction plate 37 is not at the HP 47. This informs the user that it is impossible to replenish the first containing area 31, which is for feeding, with sheets contained in the second containing area 32, which is for replenishment. Further, in the above situation, when the absence of sheets in the second containing area 32 is detected, the first warning prompts return of the restriction plate 37 to the HP 47, and hence the user is prompted to return the sheet feeding cassette 91 to a state in which sheet replenishment is possible. Also, in the above situation, when the presence of sheets in the second containing area 32 is detected, the second warning is issued. Specifically, even if the sheet feeding cassette 91 is closed, the user is notified that sheets cannot be transferred into the first containing area 31 using the restriction guide 37 and prompted to put the restriction plate 37 back to the HP 47. Thus, the user is informed that sheet replenishment is impossible and primped to return the sheet feeding cassette 91 to a state in which sheet replenishment is possible.

Also, after the second warning is issued, when the sheet feeding cassette 91 is closed with the restriction plate 37 not at the HP 47, the third warning is issued (steps S1015 to S1017). This informs the user that it is possible to feed sheets from the first containing area 31, but sheet replenishment is impossible, and prompts the user to return the sheet feeding cassette 91 to a state in which sheet replenishment is possible.

When the restriction plate 37 is put back to the HP 47 during issuance of a warning, the issuance of the warning is canceled, which informs the user that the sheet feeding cassette 91 has returned to a state in which sheet replenishment is possible.

In the first embodiment, the first sheet sensor 41, the second sheet sensor 42, the restriction plate end sensor 44, and the restriction plate HP sensor 45 are able to perform the detecting function even when the sheet feeding cassette 91 is open. On the contrary, in a second embodiment of the present invention, it is assumed that, for example, these sensors 41, 42, 44, and 45 cannot perform the detecting function due to a mechanical configuration of the sheet feeding device 51 when the sheet feeding cassette 91 is open. Therefore, a description will be given of the second embodiment with reference to FIG. 11 in place of FIG. 10 showing the first embodiment.

Figure 11:
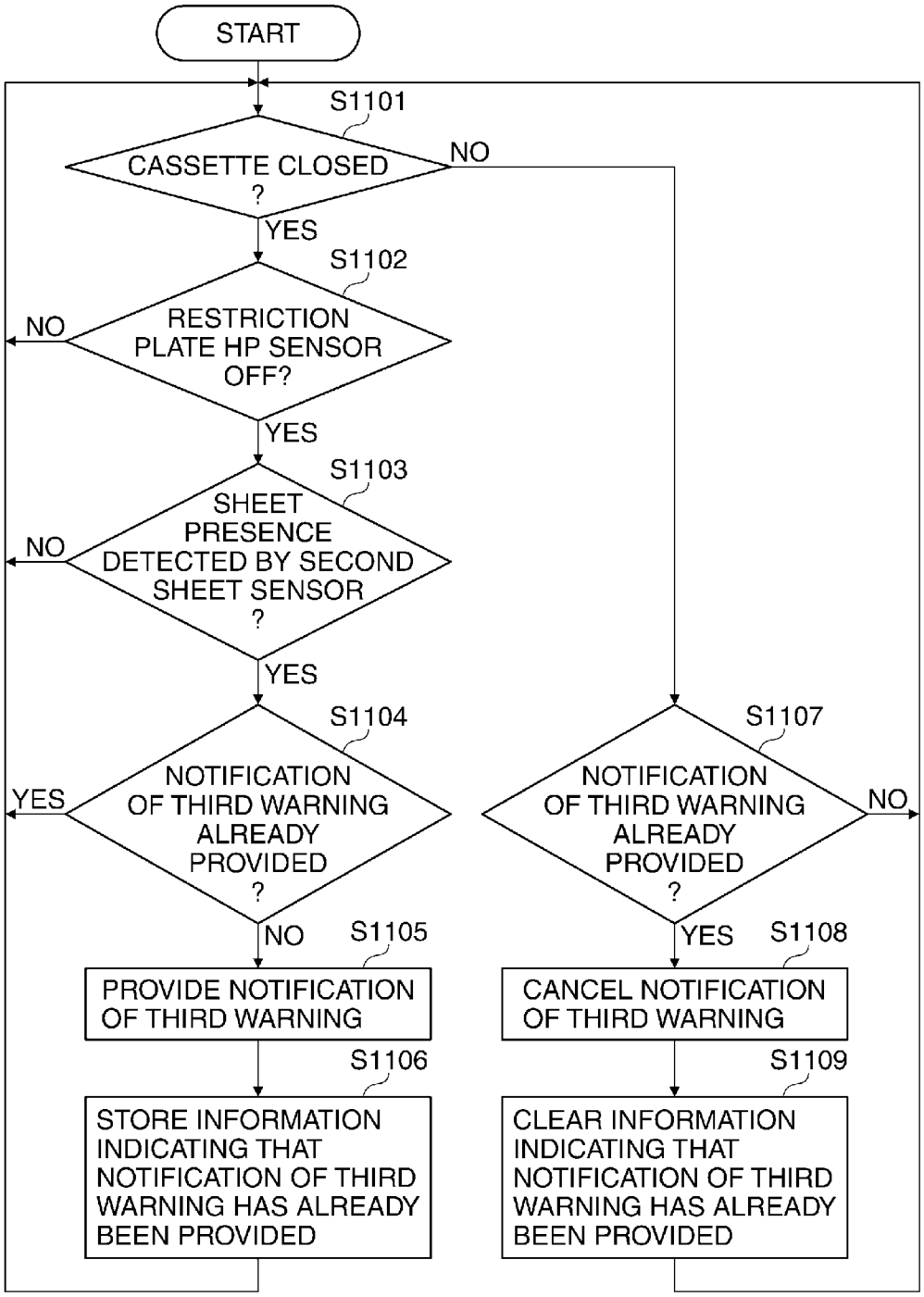
FIG. 11 is a flowchart showing a warning process.

FIG. 11 is a flowchart showing a warning process. This process is started in response to turning-on of the power to the image forming apparatus and carried out at regular time intervals.

First, based on a result of detection by the open/close sensor 43, the CPU 301 determines whether or not the sheet feeding cassette 91 is closed (step S1101). As a result of this determination, when the sheet feeding cassette 91 is closed, the CPU 301 determines whether or not the result of detection by the restriction plate HP sensor 45 is OFF (step S1102). As a result of this determination, when the result of detection by the restriction plate HP sensor 45 is OFF, the restriction plate 37 is not at the HP 47. In this case, the CPU 301 determines whether or not "sheets are present in the second containing area 32", that is, whether or not there are sheets in the second containing area 32 based on a result of detection by the second sheet sensor 42 (step S1103). As a result of this determination, when there are sheets in the second containing area 32, the sheet feeding cassette 91 is closed, the restriction plate 37 is not at the HP 47, and moreover, sheets are contained in the second containing area 32. As an example of this case, a case in which the user has pulled out the sheet feeding cassette 91, manually moved the restriction plate 37 to a position corresponding to the end of transfer, placed sheets in the second containing area 32, and installed the sheet feeding cassette 91 as it is imagined. In this case, although feeding of sheets from the first containing area 31 is possible, sheets in the second containing area 32 cannot be transferred to the first containing area 31 when sheets in the first containing area 31 runs out, and therefore, it is necessary to issue a warning.

Accordingly, the CPU 301 determines whether or not notification of the third warning has already been provided based on whether or not the corresponding information is stored in the RAM 303 (step S1104). When the CPU 301 determines notification of the third warning has already been provided, the process returns to the step S1101. On the other hand, when notification of the third warning has not yet been provided, the CPU 301 provides notification of the third warning (FIG. 9D) (step S1105) and stores, in the RAM 303, information indicating that notification of the third warning has already been provided (step S1106), followed by the process returning to the step S1101.

As a result of the determination in the step S1102, when the result of detection by the restriction plate HP sensor 45 is ON, the restriction plate 37 has retracted to the HP 47. As a result of this determination in the step S1103, when there is no sheet contained in the second containing area 32, sheets have not yet been contained in the second containing area 32 with the restriction plate 37 moved to a position corresponding to the end of transfer. Thus, in these cases, the process returns to the step S1101 without the CPU 301 issuing a warning.

As a result of this determination in the step S1101, when the sheet feeding cassette 91 is open, a status cannot be obtained through detection by the sensors 41, 42, 44, and 45. Accordingly, the CPU 301 determines whether or not notification of the third warning has already been provided based on whether or not the corresponding information is stored in the RAM 303 (step S1107). When the CPU 301 determines that notification of the third warning has already been provided, there is no warning that should be canceled, and hence the process returns to the step S1101. On the other hand, when notification of the third warning has not yet been provided, the CPU 301 stops issuance of the third warning (step S1108). Specifically, the CPU 301 deletes a message regarding the third warning (FIG. 9D) displayed on the display 311 of the UI 330. Further, the CPU 301 stores, in the RAM 303, information indicating that notification of the third warning has already been provided (step S1109), followed by the process returning to the step S1101.

According to the present embodiment, when the sheet feeding cassette 91 is closed, the restriction plate 37 is not at the HP 47, and there are sheets contained in the second containing area 32, the third second warning is issued. As a result, when a situation in which sheet replenishment is impossible arises when the sheet feeding cassette 91 is closed, a user is informed to that effect, even if a status of the sheet feeding cassette 91 cannot be obtained when the sheet feeding cassette 91 is open. Particularly, as with the first embodiment, the user is informed that feeding of sheets from the first containing area 31 is possible, but sheet replenishment is impossible, and prompted to return the sheet feeding cassette 91 to a state where sheet replenishment is possible.

Moreover, when the sheet feeding cassette 91 returns to the opened state during issuance of the third warning, the issuance of the third warning is canceled, which informs the user that the sheet feeding cassette 91 has returned to a state where sheet replenishment is possible.

It should be noted that although in the embodiments described above, the controller 300 is provided in the image forming apparatus, the present invention is not limited to this. The sheet feeding device 51 may be configured to have a function of carrying out processes such as sheet transfer in the sheet feeding device 51 among functions of the controller 300, and the sheet feeding device 51 configured as such may be installed in the image forming apparatus.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176940, filed Sep. 8, 2015 which is hereby incorporated by reference herein in its entirety.

What is claimed is:

1. A sheet feeding apparatus comprising:

a sheet feeding cassette including:

a first containing area configured to contain sheets to be fed;

a second containing area adjacent to the first containing area and configured to contain replenishing sheets; and a sheet mover that transfers the sheets contained in the second containing area to the first containing area;

a first detector configured to detect whether the sheet mover is at a standby position;

a second detector configured to detect presence or absence of sheets in the second containing area; and an annunciator configured to, in a case where the first detector detects that the sheet mover is not at the standby position, issue a warning that prompts return of the sheet mover to the standby position, wherein in a case where the first detector detects that the sheet mover is not at the standby position and the second detector detects sheets in the second containing area, the annunciator issues a warning that the sheets in the second containing area cannot be transferred to the first containing area.

2. The sheet feeding apparatus according to claim 1, further comprising:

a third detector configured to detect whether the sheet feeding cassette is in an opened state for receiving new sheets or a closed state for feeding sheets from the first containing area, wherein, in a case where the first detector detects that the sheet mover is not at the standby position, the second detector detects sheets in the second containing area, and the third detector detects that the sheet feeding cassette is in the closed state, the annunciator provides notification that feeding of sheets from the first containing area is possible and sheets cannot be transferred to the first containing area using the sheet mover, and issues a warning that prompts return of the sheet mover to the standby position.

3. The sheet feeding apparatus according to claim 1, further comprising a controller configured to control the sheet mover to transfer the replenishing sheets contained in the second containing area to the first containing area by moving the sheet mover from the standby position in a case where the first containing area contains no sheet and the second containing area contains sheets.

4. The sheet feeding apparatus according to claim 3, wherein the controller causes the sheet mover to be moved to the standby position in a case where transfer of the sheets contained in the second containing area to the first containing area is completed.

5. A sheet feeding apparatus comprising:

a sheet feeding cassette including:

a first containing area configured to contain sheets to be fed;

a second containing area adjacent to the first containing area and configured to contain replenishing sheets; and a sheet mover that transfers the sheets contained in the second containing area to the first containing area;

a first detector configured to detect whether the sheet mover is at a standby position;

a second detector configured to detect whether the sheet feeding cassette is in an opened state for receiving new sheets or a closed state for feeding sheets from the first containing area; and an annunciator configured to, in a case where the first detector detects that the mover is not at the standby position, issue a warning that prompts return of the sheet mover to the standby position.

6. The sheet feeding apparatus according to claim 5, further comprising:

a third detector configured to detect presence or absence of sheets in the second containing area, wherein in a case where the first detector detects that the sheet mover is not at the standby position, the third detector detects sheets in the second containing area, and the second detector detects that said sheet feeding cassette is in the opened state, the annunciator issues a warning that sheets cannot be transferred to the first containing area using the sheet mover even in a case where the sheet feeding cassette is brought into the closed state.

7. A sheet feeding apparatus comprising:

a sheet feeding cassette including:

a first containing area configured to contain sheets to be fed;

a second containing area adjacent to the first containing area and configured to contain replenishing sheets; and a sheet mover that transfers the sheets contained in the second containing area to the first containing area;

a detector configured to detect whether the sheet mover is at a standby position; and an annunciator configured to, in a case where the detector detects that the sheet mover is not at the standby position, issue a warning that prompts return of the sheet mover to the standby position, wherein, in a case where the first detector detects that the sheet mover is at the standby position during issuance of a warning, the annunciator cancels the warning.

8. A sheet feeding apparatus comprising:

a sheet feeding cassette including:

a first containing area configured to contain sheets to be fed;

a second containing area adjacent to the first containing area and configured to contain replenishing sheets; and a sheet mover that transfers the sheets contained in the second containing area to the first containing area;

a first detector configured to detect whether the sheet mover is at a standby position;

a second detector configured to detect presence or absence of sheets in the second containing area;

a third detector configured to detect whether the sheet feeding cassette is in an opened state for receiving new sheets or a closed state for feeding from the first containing area; and an annunciator configured to issue a warning that prompts return of the sheet mover to the standby position in a case where the first detector detects that the sheet mover is not at the standby position, the second detector detects sheets in the second containing area, and the third detector detects that the sheet feeding cassette is in the closed state.

9. The sheet feeding apparatus according to claim 8, wherein in a case where the first detector detects that the sheet mover is not at the standby position, the second detector detects sheets in the second containing area, and the third detector detects that the sheet feeding cassette is in the closed state, the annunciator provides notification that feeding of sheets from the first containing area is possible and sheets cannot be transferred to the first containing area using the sheet mover, and issues a warning that prompts return of the sheet mover to the standby position.

10. The sheet feeding apparatus according to claim 8, wherein, in a case where the third detector detects that the sheet feeding cassette is in the opened state during issuance of a warning, the annunciator cancels the warning.

11. The sheet feeding apparatus according to claim 8, wherein in a case where the second detector detects no sheet in the second containing area, the annunciator issues no warning.

12. The sheet feeding apparatus according to claim 8, further comprising a controller configured to control the sheet mover to transfer the replenishing sheets contained in the second containing area to the first containing area by moving the sheet mover from the standby position in a case where the first containing area contains no sheet and the second containing area contains sheets.

13. The sheet feeding apparatus according to claim 12, wherein the controller causes the sheet mover to be moved to the standby position in a case where transfer of sheets contained in the second containing area to the first containing area is completed.

14. An image forming apparatus comprising:

a sheet feeding apparatus comprising:

a sheet feeding cassette including:

a first containing area configured to contain sheets to be fed;

a second containing area adjacent to the first containing area and configured to contain replenishing sheets; and a sheet mover that transfers the sheets contained in the second containing area to the first containing area;

a first detector that detects whether the sheet mover is at a standby position;

a second detector that detects presence or absence of sheets in the second containing area;

a third detector that detects whether the sheet feeding cassette is in an opened state for receiving new sheets or a closed state for feeding from the first containing area; and an annunciator that issues a warning that prompts return of the sheet mover to the standby position in a case where the first detector detects that the sheet mover is not at the standby position, the second detector detects sheets in the second containing area, and the third detector detects that the sheet feeding cassette is in the closed state; and an image forming unit configured to form an image on a sheet fed from the first containing area.

* * * * *